US005794744A

United States Patent [19]

Lin

[11] Patent Number: 5,794,744

[45] Date of Patent: Aug. 18, 1998

[54] WHEELED LUGGAGE ASSEMBLY

[75] Inventor: Shin-Fu (Eiken) Lin, Taipei, Taiwan

[73] Assignee: Paragon Luggage, Inc., Tustin, Calif.

[21] Appl. No.: 744,466

[22] Filed: Nov. 7, 1996

[51] Int. Cl.[6] ..... A45C 5/14; A45C 13/04

[52] U.S. Cl. ..... 190/18 A; 190/127

[58] Field of Search ..... 190/18 A, 122, 190/127

[56] References Cited

U.S. PATENT DOCUMENTS

| | | | |
|---|---|---|---|
| 4,192,408 | 3/1980 | Walker | 190/18 A |
| 5,115,895 | 5/1992 | Myers | 190/18 A |
| 5,253,739 | 10/1993 | King | 190/18 A |
| 5,393,079 | 2/1995 | Wang | 190/18 A X |
| 5,499,702 | 3/1996 | Wang | 190/18 A X |
| 5,524,737 | 6/1996 | Wang | 190/18 A |
| 5,575,361 | 11/1996 | Chou | 190/18 A |
| 5,634,538 | 6/1997 | Tsai | 190/18 A |

FOREIGN PATENT DOCUMENTS

| | | | |
|---|---|---|---|
| 153354 | 9/1953 | Australia | 190/18 A |

*Primary Examiner*—Sue A. Weaver
*Attorney, Agent, or Firm*—Jack A. Kanz

[57] ABSTRACT

Wheeled luggage apparatus having a pair of independent wheel assemblies is formed with a frame having first, second, third and fourth sidewalls. A first notch (which extends from edge to interior side surfaces of the first and second sidewalls) and a second notch (which extends from edge to interior side surfaces of the second and third sidewalls) are formed in the frame. First and second wheel assemblies, each fully independent from the other, are mounted to the frame of the wheeled luggage apparatus. Each of the independent wheel assemblies is comprised of first and second subassemblies. Each of the first subassemblies are comprised of a central wheel well and first and second flanges while each of the second subassemblies are comprised of a central portion and first and second flanges. The first subassemblies are mounted to the frame such that the wheel wells are received in respective ones of the notches while the second subassemblies are mounted to the frame such that a space is defined between the wheel well and the central portion. A wheel mount is attached to an interior side surface of each wheel well and positioned in the space between the first and second subassemblies. Each wheel mount includes a shaft which extends through an aperture formed in the wheel well. A wheel is mounted to each shaft such that it is positioned within the corresponding wheel well into which the shaft projects.

20 Claims, 3 Drawing Sheets

WHEELED LUGGAGE ASSEMBLY

This invention relates to wheeled luggage. More particularly, it relates to a wheeled luggage apparatus having independent wheel assemblies respectively mounted to first and second corners of a frame portion thereof for supporting the luggage during transport.

BACKGROUND OF THE INVENTION

Whether for business or pleasure, many travellers find it necessary to use one or more pieces of luggage. This task is often the most unfavorable event of a trip, particularly in view of the long distances which often separate local transportation and parking areas from the baggage check-in, pick-up counters and gates of modern airports. To ease the task of carrying one or more pieces of luggage, travellers often use wheeled conveyances, commonly known as baggage handcarts, to transport luggage. While baggage handcarts ease the difficulties associated with transporting luggage, such devices are often disfavored in that most airlines count handcarts as a separate item of baggage for check-in or carry-on.

To eliminate the hand cart as a separate item, many manufacturers have incorporated the handcart into the luggage itself. Such luggage is commonly referred to as "wheeled" luggage. Generally, wheeled luggage is characterized by including an elongated handle which permits the luggage to be readily tipped and supported at an angle and a pair of wheels on which the tipped luggage will roll. The wheel assemblies are generally comprised of a large number of interconnected parts, thereby causing the manufacture of wheeled luggage to remain rather complex. For example, U.S. Pat. No. 5,393,079 to Wang discloses a wheeled luggage assembly in which a single L-shaped member attached to the body portion is formed with a pair of lugs through which a single axle is inserted. Separate wheel protectors and wheels are mounted thereon.

To simplify manufacturing, reduce manufacturing costs and reduce the mass and number of parts used to assemble wheeled luggage, it is desireable to provide a frame structure which supports (and is supported by) independent wheel assemblies and also forms a major portion of the body of the luggage piece.

SUMMARY OF THE INVENTION

In accordance with the present invention, wheeled luggage apparatus is provided which comprises a frame with two or more independently mounted wheel assemblies. Each wheel assembly is comprised of first and second subassemblies. The first subassembly is mounted to exterior side surfaces of first and second sidewalls of the frame. The second subassembly is mounted to interior side surfaces of the first and second sidewalls. The first subassembly includes a wheel well and first and second flanges and is positioned such that the first flange engages the exterior side surface of the first sidewall. The second flange engages the exterior side surface of the second sidewall and the wheel well is received in a notch which extends from the edge side surfaces of the first and second sidewalls to interior side surfaces thereof. The second subassembly includes a central portion and first and second flanges and is positioned such that the first flange engages the interior side surface of the first sidewall, the second flange engages the interior side surface of the second sidewall and a space is defined between an interior side surface of the wheel well and the central portion. A wheel mount attached to the interior side surface of the wheel well is positioned in the space between the wheel well and the central portion. The wheel mount includes a shaft which extends through an aperture between the interior side surface and an exterior side surface of the wheel well. A wheel positioned in the wheel well is mounted to the shaft of the wheel mount.

The first and second flanges of each subassembly are generally orthogonal to each other and at least one bolt attaches the first flange of the first subassembly and the first flange of the second subassembly to the first sidewall. At least one bolt attaches the second flange of the first subassembly and the second flange of the second subassembly to the second sidewall.

The wheeled luggage assembly of the invention may include a soft wall attached to the first and second sidewalls of the frame. The first and second subassemblies may further include a third flange, generally orthogonal to the first and second flanges, which engages the soft wall. Preferably, at least one bolt attaches the third flange of the first subassembly and the third flange of the second subassembly to the soft wall.

Another embodiment of the present invention includes a generally rectangular frame with a notch formed therein which extends from edge side surfaces of first and second sidewalls of the frame to interior side surfaces thereof and a wheel assembly mounted to the generally rectangular frame. The wheel assembly is comprised of first and second subassemblies, the first of which includes a wheel well and first and second flanges and the second of which includes a central portion and first and second flanges. The first subassembly is mounted to the frame such that the wheel well is received in the notch, the first flange engages an exterior surface of the first sidewall and the second flange engages an exterior surface of the second sidewall. Similarly, the second subassembly is mounted to the frame such that the first flange engages an interior surface of the first sidewall, the second flange engages an interior surface of the second sidewall and a space is defined between the wheel well and the central portion.

The wheel well may include an interior side surface which partially defines the space between the wheel well and the central portion of the second subassembly, an exterior side surface and an aperture between the two. A wheel mount, which includes a shaft extending through the aperture, is attached to the interior side surface of the wheel well and a wheel, positioned in the wheel well, is mounted on the shaft.

The wheel well of the first subassembly is comprised of a first sidewall in which the aperture is formed and a second sidewall generally orthogonal to the first sidewall, the central portion of the second subassembly is comprised of a first sidewall and a second sidewall generally orthogonal to the first sidewall. Preferably, the first sidewall of the central portion is generally parallel with the first sidewall of the wheel well and the second sidewall of the central portion is spaced a specified distance apart from the second sidewall of the wheel well.

In yet another embodiment of the present invention, wheeled luggage is provided which has a generally rectangular frame including first, second, third and fourth sidewalls. A first notch extending from edge to interior side surfaces of the first and second sidewalls and a second notch extending from edge to interior side surfaces of the second and third sidewalls are formed in the frame. A first wheel assembly and a second wheel assembly, fully independent from the first wheel assembly, are mounted to the frame of the wheeled luggage apparatus. Each of the independent wheel assemblies are comprised of first and second subassemblies, the first assemblies each comprised of a central wheel well and first and second flanges and the second assemblies each comprised of a central portion and first and second flanges. The first subassembly of the first wheel assembly is mounted to the frame such that the wheel well is received in the first notch, the first flange engages the exterior surface of the first sidewall and the second flange engages the exterior surface of the second sidewall while the second subassembly of the first wheel assembly is mounted to the frame such that the first flange engages the interior surface of the first sidewall, the second flange engages the interior surface of the second sidewall and a space is defined between the wheel well and the central portion. Similarly, the first subassembly of the second wheel assembly is mounted to the frame such that the wheel well is received in the second notch, the first flange engages the exterior surface of the third sidewall and the second flange engages the exterior surface of the second sidewall while the second subassembly of the second wheel assembly is mounted to the frame such that the first flange engages the interior surface of the third sidewall, the second flange engages the interior surface of the second sidewall and a space is defined between the wheel well and the central portion. For each wheel assembly, a wheel mount is attached to an interior side surface of the corresponding wheel well and positioned in the space between the first and second subassemblies. Each wheel well includes a shaft which extends through an aperture formed between the interior side surface and an exterior side surface of the wheel well. A wheel is mounted on each shaft such that it is positioned within the corresponding wheel well into which the shaft projects.

The flanges of the first and second subassemblies of each of the wheel assemblies are generally orthogonal to each other and bolts attach the flanges of the first subassemblies to the corresponding flanges of the second subassemblies. A soft wall is attached to the first, second, third and fourth sidewalls and each subassembly of the wheeled luggage apparatus includes a third flange, generally orthogonal to the first and second flanges of the subassembly, engaged with the soft wall and bolts which attach the third flanges of each subassembly to the soft wall.

The invention will be better understood and its numerous features and advantages will become apparent to those skilled in the art by reference to the following detailed description taken in connection with the attached drawing in which:

DESCRIPTION OF THE PREFERRED EMBODIMENTS

Figure 2:
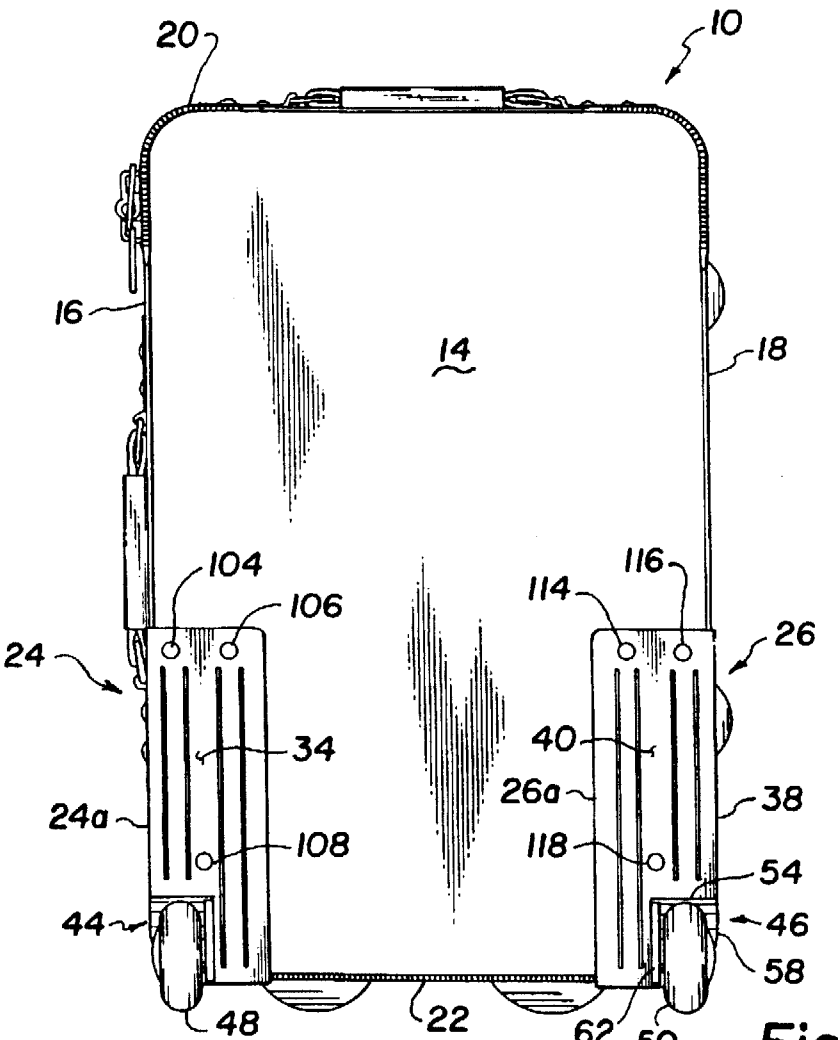
FIG. 2 is a rear view of the wheeled luggage of FIG. 1.
Figure 1:
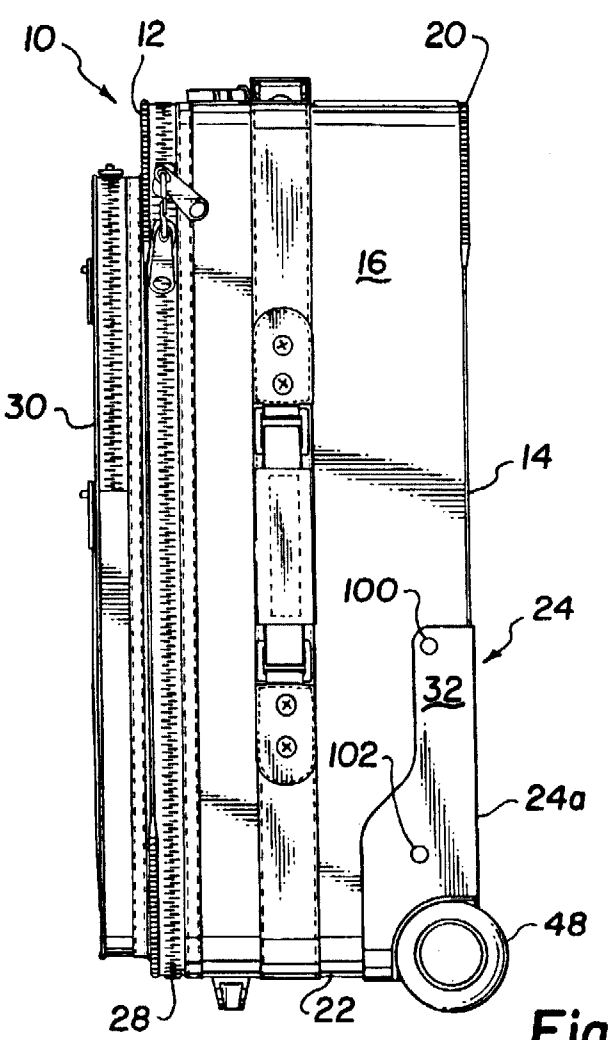
FIG. 1 is a side elevational view of wheeled luggage which includes first and second wheel assemblies, each fully independent from the other, constructed in accordance with the teachings of the present invention.
Figure 3:
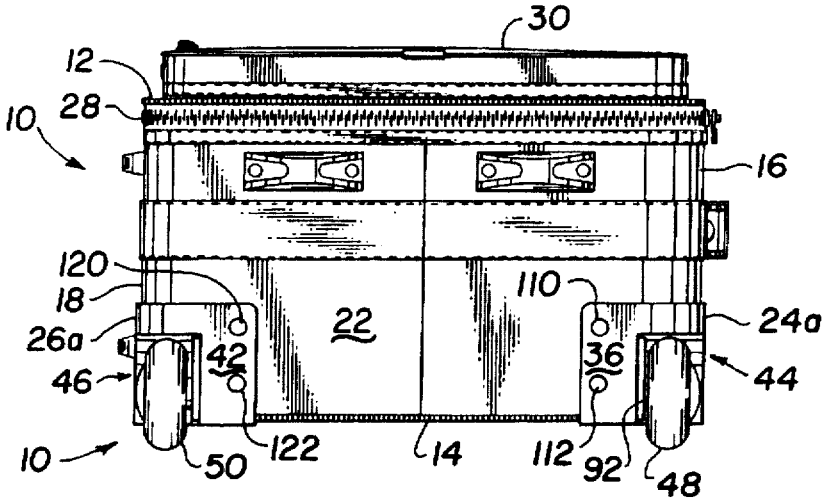
FIG. 3 is a bottom view of the wheeled luggage of FIG. 1.

FIGS. 1–3 illustrate a wheeled luggage apparatus 10 having first and second wheel assemblies 24 and 26, each separately mounted to the wheeled luggage apparatus 10 and fully independent of each other. The apparatus 10 includes a top wall 12, a bottom wall 14 and a generally rectangular frame which forms first, second, third and fourth sidewalls 16, 18, 20 and 22. Collectively, the top wall 12, the bottom wall 14 and the first, second, third and fourth sidewalls 16, 18, 20 and 22 define an interior storage area for holding articles of clothing or other items. As is common in modern luggage, the bottom wall 14 and first, second, third and fourth sidewalls 16, 18, 20 and 22 are joined to each other while the top wall 12 is attached to the second sidewall 18 by a hinge structure and attached to the first, third and fourth sidewalls 16, 20 and 22 by a zipper 28. If desired, the top wall 12 (or other walls) may have one or more closeable and/or removeable pockets 30 or the like attached thereto.

The wheeled luggage apparatus 10 disclosed herein is of the "semi-soft luggage" type. Accordingly, the top and bottom walls 12 and 14 are formed of a suitable fabric material (for example, nylon) while the first, second, third and fourth sidewalls 16, 18, 20 and 22 have a stiffened or semi-rigid frame member (not visible in FIGS. 1–3 but preferably constructed to have a honeycomb configuration) sandwiched between layers of the fabric material. It should be understood that the invention is equally suitable for use in conjunction with other and more traditional types of luggage.

The first wheel assembly 24 is comprised of first and second subassemblies **24*a* and 24*b*, only the first of which is visible in FIGS. 1–3. The first subassembly 24*a* of the wheel assembly 24 includes a vertically extending member (or flange) 32 mounted to the first sidewall 16 by bolts 100 and 102, a second vertically extending member 34 mounted to the bottom wall 14 by bolts 104, 106 and 108, and a horizontally extending member 36 mounted to the fourth sidewall 22 by bolts 110 and 112. While not clearly visible in FIGS. 1–3, the bolts 100 and 102 extend through apertures in the vertically extending member 32, the first sidewall 16 and a corresponding member of the second subassembly 24*b*. The bolts 104, 106 and 108 extend through the second vertically extending member 34, the bottom wall 14 and a corresponding member of the second subassembly 24*b*. The bolts 110 and 112 extend through the horizontally extending member 36, the fourth sidewall 22 and a corresponding member of the second subassembly 24*b*. In this manner, the bolts 100 through 112 secure both the first and second subassemblies 24*a* and 24*b* to the wheeled luggage apparatus 10**.

Figure 5:
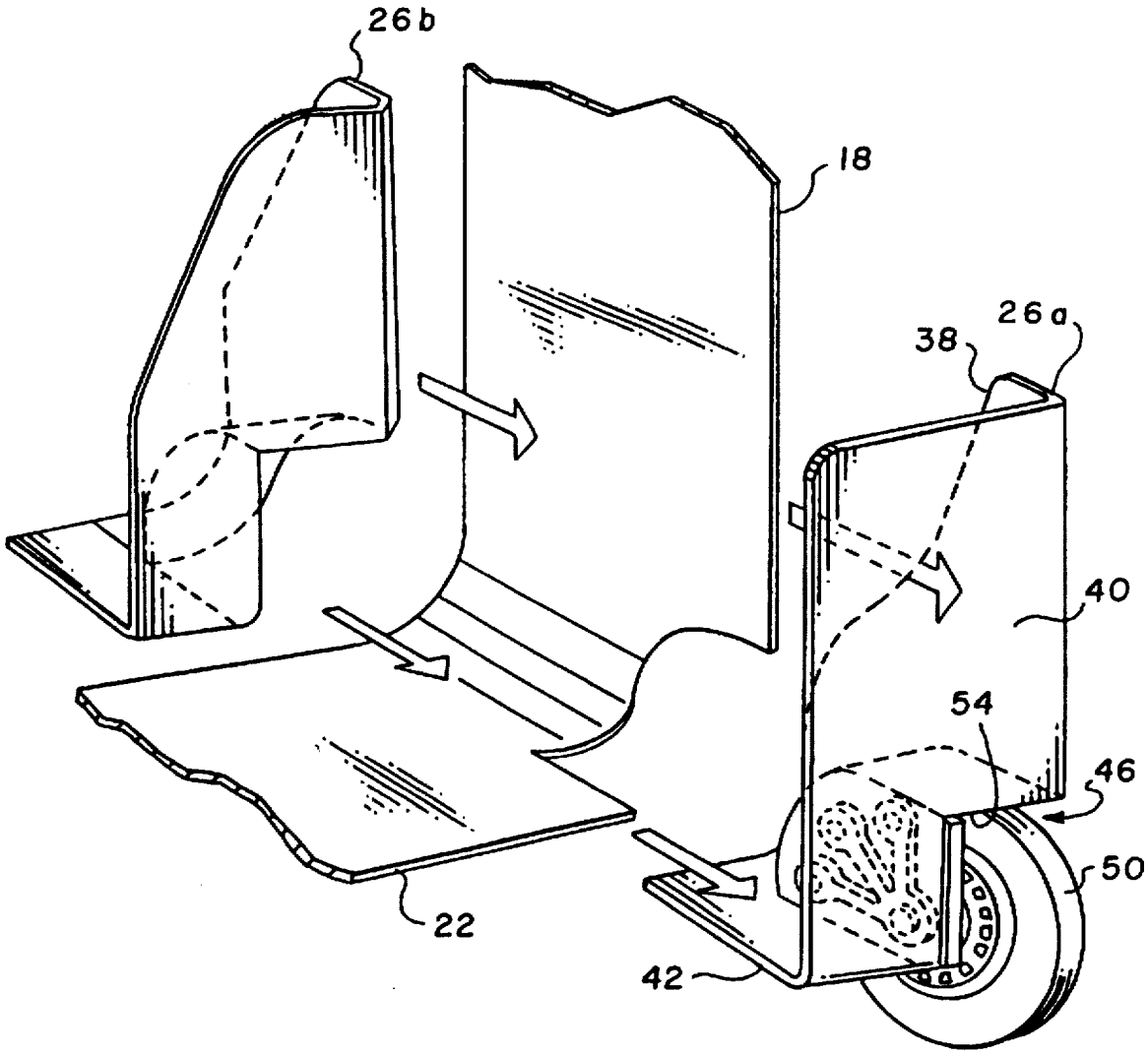

It should be understood that various other types of mounting devices, for example, rivets or screws are equally suitable for mounting the first subassembly **24*a* to the wheeled luggage apparatus 10. It should be further noted that the number of bolts, rivets, screws or other mounting devices used to mount the first and second subassemblies 24*a* and 24*b* to the wheeled luggage apparatus 10 may be readily varied. Similarly, the second wheel assembly 26 is comprised of first and second subassemblies 26*a* and 26*b*, as shown in FIG. 5. Again, only the first subassembly is visible in FIGS. 1–3. The first subassembly 26*a* of the wheel assembly 26 includes a first vertically extending member 38 mounted to the second sidewall 18 by first and second bolts (not visible in FIGS. 1–3), a second vertically extending member 40 mounted to the bottom wall 14 by bolts 114, 116 and 118 and a horizontally extending member 42 mounted to the fourth sidewall 22 by bolts 122. Preferably, the first and second subassemblies 26*a* and 26*b* are mounted to the wheeled luggage apparatus 10 in a manner similar to that mounting the first and second subassemblies 24*a* and 24*b***.

Accordingly, further description of how the first and second subassemblies 26*a* and 26*b* are mounted to the wheeled luggage apparatus 10 is not necessary.

Preferably, the first vertically extending, second vertically extending and horizontally extending members 32, 34 and 36, 38, 40 and 42 of the first subassemblies 24*a*, 26*a* are integrally formed with each other in a generally orthogonal relationship. The first subassemblies 24*a*, 26*a* of each wheel assembly 24, 26 further include indentations 44, 46 located in the general center thereof which, as more fully described below, define wheel wells within which wheels 48, 50 may revolve around a shaft. Each indentation 44, 46 is defined by a first (generally horizontal) interior sidewall 52, 54, a second (generally vertical) interior sidewall 56, 58 and a third (generally vertical) interior sidewall 60, 62. The first interior sidewall 52, 54 is generally parallel with the horizontally extending member 36, 42. The second interior sidewall 56, 58 is generally parallel with the second vertically extending member 34, 40 and the third interior sidewall 60, 62 is generally parallel with the first vertically extending member 32, 38. Preferably, the first and second interior sidewalls 52 and 56, 54 and 58 each include a curved portion as shown more clearly in FIG. 4.

Figure 4:
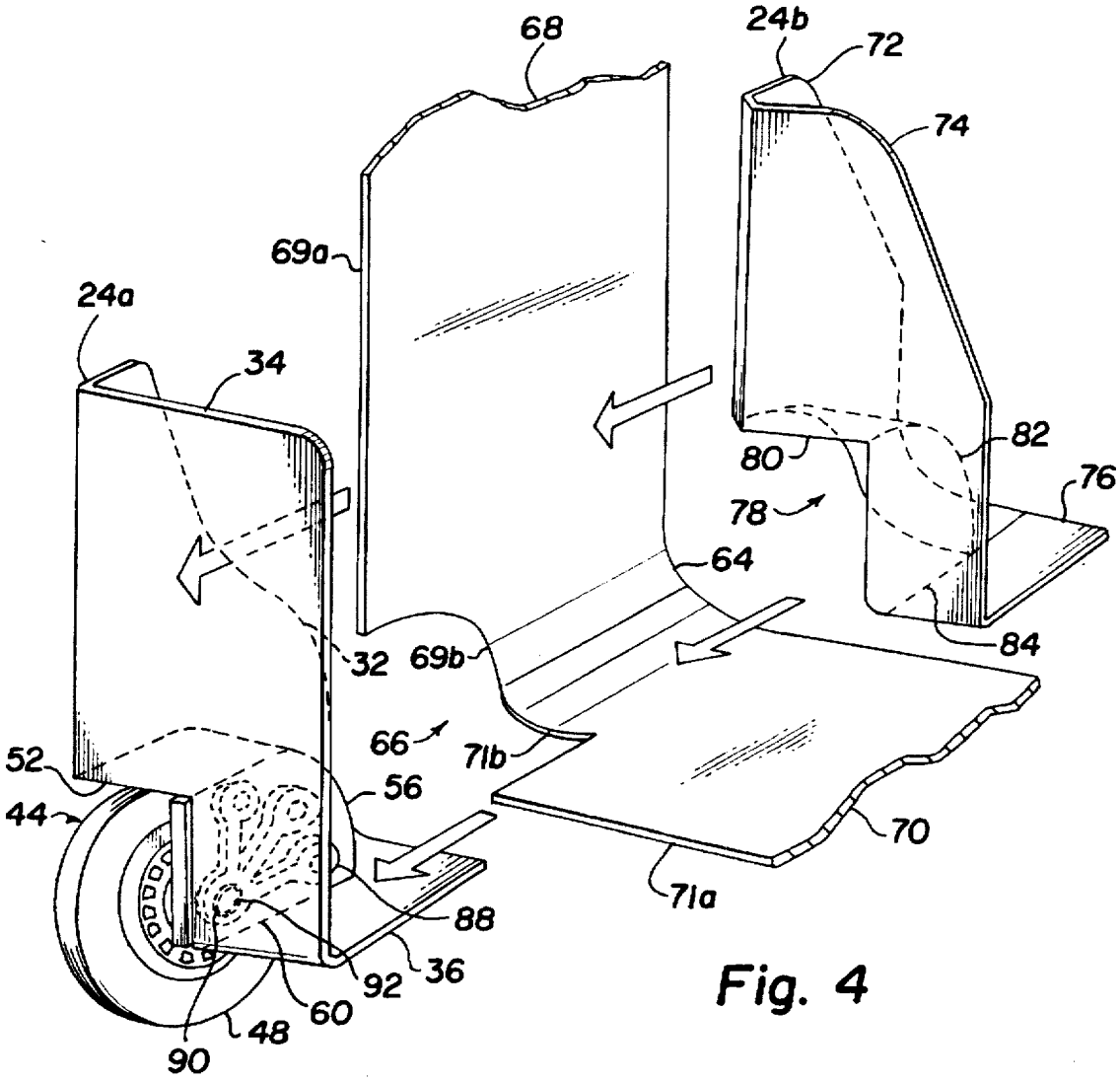
FIG. 4 is a fragmentary exploded view of the wheeled luggage of FIGS. 1–3 (shown with the bottom side surface removed) which illustrates an independent wheel assembly of the present invention; and, FIG. 5 is a fragmentary exploded view similar to FIG. 4 which illustrates another independent wheel assembly of the present invention.

The preferred configuration of the wheel assembly 44 is shown in greater detail in FIG. 4. Of course, the wheeled luggage apparatus 10 has a second wheel assembly 46 configured identically to the first wheel assembly 44 except that the two wheel assemblies 44, 46 are mounted on opposite ends of the fourth sidewall 22. It should also be noted that the bottom wall 14 has been omitted from FIG. 4 for clarity of illustration.

As illustrated in FIG. 4, a portion of the stiffened frame 64 (previously hidden from view by one or more layers of covering material) which forms first and fourth sidewalls 16 and 22 may be seen. The layers of fabric between which the frame 64 is sandwiched have been omitted from FIG. 4 for clarity of illustration.

In the embodiment of the invention illustrated, first portion 68 of the frame 64 which forms the first sidewall 16 and second portion 70 of the frame 64 which forms the fourth sidewall 22 are generally orthogonal to each other and are joined together in a rounded corner. A notch 66 centered at the rounded corner and extending generally equal distances along an edge side surface 69*a* of the first portion 68 and an edge side surface 71*a* of the second portion 70 is formed in the frame 64. The notch 66 extends into the first and second portions 68 and 70 generally equal depths such that an interior side surface 69*b* of the first portion 68 and an interior side surface 71*b* of the second portion 70 are generally orthogonal to each other.

Preferably, the notch 66 is dimensioned such that the first, second and third interior sidewalls 52, 54 and 60 (as well as any structure coupled thereto) of the first subassembly 34 of the first wheel assembly 44 may be received therein. Accordingly, the height and depth of the notch 66 should be approximately the same as the height and depth of the third sidewall 60. As will be more fully described below, the width of the notch 66 should be sufficiently greater than the length of the sidewall 52 so that wheel mount 88 may also be accommodated within the notch 66.

As previously described, the wheel assembly 24 further includes a second subassembly 24*b* comprised of a vertically extending member 72 mounted to the first sidewall 16, a second vertically extending member 74 mounted to the bottom wall 14 and a horizontally extending member 76 mounted to the fourth sidewall 22. Like the first portion 24*a* of wheel subassembly 24, the second portion 24*b* further includes an indentation 78 defined by a first (generally horizontal) interior sidewall 80, a second (generally vertical) interior sidewall 82 and a third (generally vertical) interior sidewall 84. The first interior sidewall 80 is generally parallel with the horizontally extending member 76, 42. The second interior sidewall 82 is generally parallel with the second vertically extending member 74 and the third interior sidewall 84 is generally parallel with the first vertically extending member 72. Preferably, the first and second interior sidewalls 80 and 82 and 84 each include a curved portion arranged in a shape which complements the curved portions of the first and second interior sidewalls 52 and 56. Thus, the indentation defined by the first, second and third interior sidewalls 80, 82 and 84 forms a central portion which complements the wheel well 44 defined by the first, second and third interior sidewalls 52, 56 and 60.

Each dimension of the first, second and third interior sidewalls 80, 82 and 84 of the second subassembly 24*b* should be proportionally greater than the corresponding dimension of the first, second and third interior sidewalls 52, 56 and 60 of the first subassembly 24*a*. The dimensions of the first, second and third interior sidewalls 80, 82 and 84 should also be sized so that when the vertically extending member 72, the second vertically extending member 74 and the horizontally extending member 76 are respectively mounted to the first portion 68 of the frame 64, the bottom wall 14 and the second portion 70 of the frame 64, the central portion defined by the first, second and third interior sidewalls 80, 82 and 84 cover the notch 66.

Fixedly attached to an inner side surface 86 of the third interior sidewall 60 is a wheel mount 88. The wheel mount 88 generally includes the structure necessary to supportably mount the wheel 48 within the wheel well 44. For example, the wheel mount 88 may include structure which absorbs forces exerted on the wheel 48 when the wheeled luggage apparatus is rolled down a stairway. The wheel 48 positioned in the wheel well 44 is coupled to the wheel mount 88 by a shaft 90 which extends through an aperture 92 in the third interior sidewall 60.

Because the present invention provides first and second wheel assemblies 44 and 46, each independent from the other, installation and repair of the wheel assemblies is simplified. For example, to mount the wheel assembly 44 to the wheeled luggage apparatus 10, the first subassembly 24*a* is positioned (relative to the wheeled luggage apparatus 10) so that the vertically extending member 32 engages an outer side surface of the first portion 68 of the frame 64, the second vertically extending member 34 engages an outer side surface of the bottom wall 14, the horizontally extending member 36 engages an outer side surface of the second portion 70 of the frame 64 and the wheel well 44 is received in the notch 66. Next, the second subassembly 24*b* is positioned (relative to the wheeled luggage apparatus 10) so that the vertically extending member 72 engages an inner side surface of the first portion 68 of the frame 64, the second vertically extending member 74 engages an inner side surface of the bottom wall 14, the horizontally extending member 76 engages an inner side surface of the second portion 70 of the frame 64 and the first, second and third interior sidewalls 80, 82 and 84 (which form the central portion of the second subassembly 24*b*) are each spaced apart a specified distance from the first, second and third interior sidewalls 52, 56 and 60, respectively, of the wheel well 44.

As shown in FIG. 4, it is within the space between the interior sidewalls 80, 82 and 84 of the second subassembly 24*b* and the interior sidewalls 52, 56 and 60 of the first subassembly 24*a* that the wheel mount 88 attached to the interior side surface of the interior sidewall 60 resides. Since the first wheel assembly 24 need not have any common structure with the second wheel assembly 26, the first wheel assembly 24 is fully independent from the second wheel assembly 26.

To complete the wheel assembly 24, bolts or other conventional securing devices are used to fixedly attach the first and second subassemblies 24*a* and 24*b* to the first and second portions 68 and 70 of the frame 64 and to the bottom wall 14. More specifically, the bolts 100 and 102 extend through aligned apertures in the vertically extending member 32, the first portion 68 of the frame 64 and the vertically extending member 72. Bolts 104, 106 and 108 extend through aligned apertures in the second vertically extending member 34, the bottom wall 14 and the second vertically extending member 74 and bolts 110 and 112 extend through aligned apertures in the horizontally extending member 36, the second portion 70 of the frame 64 and the horizontally extending member 76 to secure the first and second subassemblies 24*a* and 24*b* to the bottom wall 14 and the first and second portions 68 and 70 of the frame 64. Of course, bolts 100–112, as well as the apertures through which the bolts 100–112 extend have been omitted from FIG. 4 for clarity of illustration.

As described and illustrated herein, a wheeled luggage assembly is provided which has an independent wheel assembly for each wheel. By providing independent wheel assemblies, the manufacture and repair of the wheeled portion of wheeled luggage apparatus is greatly simplified. Furthermore, by eliminating the shaft, shaft housing and other structure traditionally used to interconnect and support a pair of wheels on the luggage, the luggage assembly of the invention provides additional storage space, particularly in the center areas thereof.

While the invention has been described with particular reference to specific embodiments thereof, it will be apparent to those skilled in the art that the same principles may be used in similar arrangements. Furthermore, it will be recognized the invention is not limited to the precise structures described. Therefore, it is to be understood that although the invention has been described with particular reference to specific embodiments thereof, the forms of the invention shown and described in detail are to be taken as preferred embodiments of same, and that various changes and modifications may be resorted to without departing from the spirit and scope of the invention as defined by the appended claims.

What is claimed:

1. A wheel assembly for luggage which includes a frame having first and second sidewalls, each having exterior, interior and edge side surfaces with a notch formed in said frame which extends from said edge side surfaces of said first and second sidewalls to interior side surfaces thereof, comprising:

a first subassembly mounted to said exterior side surfaces of said first and second sidewalls;

a second subassembly mounted to said interior side surfaces of said first and second sidewalls;

said first subassembly including first and second flanges and a central wheel well having interior and exterior side surfaces with an aperture extending between the interior and exterior surfaces;

said second subassembly including a central portion and first and second flanges;

said first subassembly mounted to said first and second sidewalls such that said wheel well is received in said notch, said first flange engages said exterior side surface of said first sidewall and said second flange engages said exterior side surface of said second sidewall;

said second subassembly mounted to said first and second sidewalls such that said first flange engages said interior side surface of said first sidewall, said second flange engages said interior side surface of said second sidewall and a space is defined between said wheel well and said central portion;

a wheel mount positioned in said space between said wheel well and said central portion, said wheel mount attached to said interior side surface of said wheel well and including a shaft which extends through said aperture; and a wheel positioned in said wheel well and mounted on said shaft of said wheel mount.

2. A wheel assembly as defined in claim 1 wherein said frame is generally rectangular, said first and second flanges of said first subassembly are generally orthogonal to each other and said first and second flanges of said second subassembly are generally orthogonal to each other.

3. A wheel assembly as defined in claim 2 and further comprising at least one bolt which attaches said first flange of said first subassembly and said first flange of said second subassembly to said first sidewall.

4. A wheel assembly as defined in claim 3 and further comprising at least one bolt which attaches said second flange of said first subassembly and said second flange of said second subassembly to said second sidewall.

5. A wheel assembly as defined in claim 2 wherein said luggage further comprises a soft wall having interior and exterior side surfaces attached to said first and second sidewalls of said generally rectangular frame and wherein said first subassembly further comprises:

a third flange generally orthogonal to said first and second flanges, said first subassembly mounted to said soft wall and said first and second sidewalls such that said third flange engages said exterior side surface of said soft wall.

6. A wheel assembly as defined in claim 5 wherein said second subassembly further comprises:

a third flange generally orthogonal to said first and second flanges, said second subassembly mounted to said soft wall and said first and second sidewalls such that said third flange engages said interior side surface of said soft wall.

7. A wheel assembly as defined in claim 6 and further comprising at least one bolt which attaches said third flange of said first subassembly and said third flange of said second subassembly to said soft wall.

8. Wheeled luggage apparatus comprising:

a generally rectangular frame forming first, second, third and fourth sidewalls, each having exterior, interior and edge side surfaces, of luggage apparatus;

a notch formed in said generally rectangular frame which extends from said edge side surfaces of said first and second sidewalls to interior side surfaces thereof; and a wheel assembly mounted to the luggage apparatus, said wheel assembly comprised of first and second subassemblies; wherein said first subassembly comprises a central wheel well and first and second flanges;

said second subassembly comprises a central portion and first and second flanges;

said first subassembly is mounted to said frame such that said wheel well is received in said notch, said first flange of the first subassembly engages said exterior surface of said first sidewall and said second flange of the first subassembly engages said exterior surface of said second sidewall; and said second subassembly is mounted to said frame such that said first flange of the second subassembly engages said interior surface of said first sidewall, said second flange of the second subassembly engages said interior surface of said second sidewall and a space is defined between said wheel well and said central portion.

9. Wheeled luggage apparatus as defined in claim 8 wherein said wheel well further comprises an interior side surface which partially defines said space, an exterior side surface and an aperture extending therebetween.

10. Wheeled luggage apparatus as defined in claim 9 and further comprising:

a wheel mount attached to said interior side surface of said wheel well, said wheel mount including a shaft which extends through said aperture; and a wheel positioned in said wheel well and mounted to said shaft.

11. Wheeled luggage apparatus as defined in claim 10 wherein said wheel well is comprised of a first sidewall and a second sidewall generally orthogonal to said first sidewall.

12. Wheeled luggage apparatus as defined in claim 11 wherein said aperture is formed in said first sidewall.

13. Wheeled luggage apparatus as defined in claim 12 wherein said central portion is comprised of a first sidewall and a second sidewall generally orthogonal to said first sidewall.

14. Wheeled luggage apparatus as defined in claim 13 wherein said first sidewall of said central portion is generally parallel with said first sidewall of said wheel well.

15. Wheeled luggage apparatus as defined in claim 14 wherein said second sidewall of said central portion is spaced a specified distance apart from said second sidewall of said wheel well.

16. Wheel luggage apparatus comprising:

a generally rectangular frame forming first, second, third and fourth sidewalls, each having exterior, interior and edge side surfaces, of luggage apparatus;

a first notch formed in said generally rectangular frame, said first notch extending from said edge side surfaces of said first and second sidewalls to interior side surfaces thereof;

a second notch formed in said generally rectangular frame, said second notch extending from said edge side surfaces of said second and third sidewalls to interior side surfaces thereof;

a first wheel assembly mounted to the luggage apparatus, said first wheel assembly including first and second subassemblies;

a second wheel assembly mounted to the luggage apparatus independent of said first wheel assembly, said second wheel assembly including first and second subassemblies;

said first subassembly of said first wheel assembly including a central wheel well having interior and exterior side surfaces with an aperture extending therebetween and first and second flanges;

said second subassembly of said first wheel assembly including a central portion and first and second flanges;

said first subassembly of said first wheel assembly being mounted on said first and second sidewalls such that said wheel well is received in said first notch, said first flange engages said exterior surface of said first sidewall and said second flange engages said exterior surface of said second sidewall;

said second subassembly of said first wheel assembly being mounted on said first and second sidewalls such that said first flange engages said interior surface of said first sidewall, said second flange engages said interior surface of said second sidewall and a space is defined between said wheel well and said central portion;

said first subassembly of said second wheel assembly including a central wheel well having interior and exterior surfaces with an aperture extending therebetween and first and second flanges;

said second subassembly of said second wheel assembly including a central portion and first and second flanges;

said first subassembly of said second wheel assembly being mounted on said second and third sidewalls such that said wheel well is received in said second notch, said first flange engages said exterior surface of said third sidewall and said second flange engages said exterior surface of said second sidewall;

said second subassembly of said second wheel assembly being mounted on said second and third sidewalls such that said first flange engages said interior surface of said third sidewall, said second flange engages said interior surface of said second sidewall and a space is defined between said wheel well and said central portion;

a first wheel mount attached to said interior side surface of said wheel well of said first subassembly of said first wheel assembly, said first wheel mount including a shaft which extends through said aperture formed in said wheel well of said first subassembly of said first wheel assembly; and a first wheel positioned in said wheel well of said first subassembly of said first wheel assembly and mounted on said shaft of said first wheel mount;

a second wheel mount attached to said interior side surface of said wheel well of said first subassembly of said second wheel assembly, said second wheel mount including a shaft which extends through said aperture formed in said wheel well of said first subassembly of said second wheel assembly; and a second wheel positioned in said wheel well of said first subassembly of said second wheel assembly and mounted on said shaft of said second wheel mount.

17. Wheeled luggage apparatus as defined in claim 16 wherein:

said first and second flanges of said first subassembly of said first wheel assembly are generally orthogonal to each other;

said first and second flanges of said second subassembly of said first wheel assembly are generally orthogonal to each other;

said first and second flanges of said first subassembly of said second wheel assembly are generally orthogonal to each other; and said first and second flanges of said second subassembly of said second wheel assembly are generally orthogonal to each other.

18. Wheeled luggage apparatus as defined in claim 17 and further comprising:

at least one bolt which attaches said first flange of said first subassembly of said first wheel assembly and said first flange of said second subassembly of said first wheel assembly to said first sidewall;

at least one bolt which attaches said second flange of said first subassembly of said first wheel assembly and said second flange of said second subassembly of said first wheel assembly to said second sidewall;

at least one bolt which attaches said first flange of said first subassembly of said second wheel assembly and said first flange of said second subassembly of said second wheel assembly to said third sidewall; and at least one bolt which attaches said second flange of said first subassembly of said second wheel assembly and said second flange of said second subassembly of said second wheel assembly to said second sidewall.

19. Wheeled luggage apparatus as defined in claim 18 and further comprising:

a soft wall attached to said first, second, third and fourth sidewalls of said generally rectangular frame;

said first subassembly of said first wheel assembly further comprising a third flange generally orthogonal to said first and second flanges, said third flange engaging said soft wall;

said second subassembly of said first wheel assembly further comprising a third flange generally orthogonal to said first and second flanges, said third flange engaging said soft wall;

said first subassembly of said second wheel assembly further comprising a third flange generally orthogonal to said first and second flanges, said third flange engaging said soft wall; and said second subassembly of said second wheel assembly further comprising a third flange generally orthogonal to said first and second flanges, said third flange engaging said soft wall.

20. Wheeled luggage apparatus as defined in claim 19 and further comprising:

at least one bolt which attaches said third flange of said first subassembly of said first wheel assembly and said third flange of said second subassembly of said first wheel assembly to said soft wall; and at least one bolt which attaches said third flange of said first subassembly of said second wheel assembly and said third flange of said second subassembly of said second wheel assembly to said soft wall.

* * * * *